United States Patent [19]

Economopoulos

[11] Patent Number: 4,810,311

[45] Date of Patent: Mar. 7, 1989

[54] PROCESS FOR MANUFACTURING A HIGH STRENGTH RAIL

[75] Inventor: Marios Economopoulos, Liege, Belgium

[73] Assignee: Centre de Recherches Metallurgiques-Centrum Voor Research in de Metallurgie, Brussels, Belgium

[21] Appl. No.: 71,689

[22] Filed: Jul. 9, 1987

[30] Foreign Application Priority Data

Jul. 10, 1986 [LU] Luxembourg ..... 86510

[51] Int. Cl.[4] ..... C21D 11/00

[52] U.S. Cl. ..... 148/128; 148/146; 148/12 B

[58] Field of Search ..... 148/156, 12 B, 146, 148/128

[56] References Cited

U.S. PATENT DOCUMENTS 4,203,783 5/1980 Economopoulos et al. ..... 148/12.4
4,486,248 12/1984 Ackert et al. ..... 148/145
4,668,308 5/1987 Economopoulos et al. ..... 148/146
4,714,500 12/1987 Heller et al. ..... 148/12 R

FOREIGN PATENT DOCUMENTS 186373 7/1986 European Pat. Off. ..... 148/146

*Primary Examiner*—Christopher W. Brody
*Attorney, Agent, or Firm*—Holman & Stern

[57] ABSTRACT

Starting from a temperature at or above the $A_3$ transformation point of the steel of the rail, the head of the rail is cooled to a temperature not lower than the Ms point at a rate lower than the critical quenching rate so that the head acquires a fine perlitic structure. Simultaneously the web is superficially cooled to the Ms point or below, at a rate greater than the head, so as to obtain a surface layer of martensite and/or bainite, and the surface cooling is controlled so that, at the end of controlled cooling, internal portions of the web not transformed to martensite and/or bainite retain sufficient heat to temper the surface layer during subsequent cooling to ambient temperature. At the same time the flange of the rail is cooled at a rate ensuring straightness of the rail.

9 Claims, 1 Drawing Sheet

PROCESS FOR MANUFACTURING A HIGH STRENGTH RAIL

BACKGROUND TO THE INVENTION

1. Field of Invention

The present invention concerns a process for manufacturing a high strength rail and apparatus to carry out this process. This process comprises a thermal treatment of the rail as soon as it comes out of the rolling mill, i.e. at the rolling heat.

2. Description of Prior Art

Due to the present trend to increase the loads and the speed of trains, the rails are subjected to ever more severe stresses, which require ever superior properties. In this respect, it is particularly important that the rails are as perfectly straight as possible and have a high level of resistance to wear, resistance to fracturing, ductility, resistance to fatigue and shock, and hardness. Finally, they must have a satisfactory weldability.

From the economic point of view, it is still advisable to keep their price reasonable, in particular by avoiding or limiting the use of alloying elements.

The mechanical properties mentioned above are particularly important in the rail flange, since it is this part, and particularly its upper region, which is subjected to the highest stresses, in particular of wear and shock.

It is known that, in order to have the requisite properties, the rail flange must be made of fine perlite free from pro-eutectoid ferrite and martensite, and possibly containing a low percentage of bainite, and that furthermore, the gradient of hardness in the flange is preferably as gentle as possible.

The steels used for the manufacture of high strength rails generally contain 0.4% to 0.85% of carbon, 0.4% to 1% manganese, and 0.1 to 0.4% silicon, the rest consisting principally of iron.

In a prior proposal which is the subject of the Belgian Pat. No. 889 617 in particular, the present applicant described a process consisting in adjusting the length of the cooling ramp, the speed of travel of the rail and the average density of the heat fluxes applied to the head, the web, and the flange of the rail in such a way that martensite does not form in any part of the section of the head, and that less than 60% of the section of the head has undergone austenite-perlite allotropic transformation on leaving the cooling ramp.

With this process it is possible to make very straight rails economically, having the required properties, in particular a Brinell hardness number of the order of 380, with steels having the composition cited above.

In fact, however, this degree of hardness is no loner adequate in every case, and users demand higher and higher Brinell hardness numbers of around 400.

It is not possible to meet this new demand with the above-mentioned process, which cannot produce sufficient cooling to achieve the required hardness without the formation of martensite.

Efforts have therefore been made to increase the hardness of the flange by adding alloying elements to the steel, for example 0.1% to 0.5% chromium and up to 1% silicon.

However, it has been shown that it is not possible to obtain the desired result by means of such an addition, i.e. a Brinell hardness number of 400 without the formation of martensite in the flange, when applying the process cited above. To obtain this result, it would in fact be necessary to reduce the cooling intensity considerably to a level incompatible with the process and apparatus of the Belgian patent cited above, and at the same time to increase the length of the cooling process by a considerable degree. The latter should, for example, be five times longer, which would lead to either a corresponding reduction in the speed of the rail, or an increase in the length of the cooling ramp and hence a blockage of the plant, involving futher necessary outlay.

Furthermore, it is not desirable to reduce the speed of the rail by a great degree, as this would result in the tail of the rail remaining too long in the air and the beginning of allotropic transformation before the start of controlled cooling.

SUMMARY OF THE INVENTION

The object of the present invention is a process whereby it is possible to produce high strength rails having a Brinell hardness number of about 400 at least in the upper region of the head, at the same time as avoiding the disadvantages referred to above.

The process which is the subject of the present invention is applied to the rail immediately it leaves the rolling mill. It is based on a surprising discovery by the applicant that the cooling of the head of the rail is influenced to a considerable degree by the conditions of cooling of the web of the rail.

In this respect, the applicant wishes to define what is understood, in practice, by the expression "immediately the rail leaves the rolling mill". It is known that the rail emerging from the rolling mill has irregularly-shaped ends which have to be cut off; to this end the rail is sent to a hot sawing station between the exit proper of the rolling mill and the controlled cooling plant. During this hot sawing process, the inevitably undergoes a certain amount of cooling in the air, but for too short a period to lower the temperature of the rail to the point where allotropic transformation begins to take place in the rail. It is after this cooling in the air that the controlled cooling, which is the subject of the invention, begins.

In the course of research with a view to increasing the hardness of the rail flange, it has surprisingly been discovered that intensive cooling of the web of the rail, combined with the proper cooling of the head, could give rise to a favourable perlitic structure in the head as well as the desired increase in hardness.

In these conditions, in the process for manfacturing a high strength rail, which is the subject of the present invention, upon its leaving the hot rolling mill, the continuously advancing rail is subjected to controlled cooling, starting at a temperature at least equal to the $A_3$ transformation point of the steel, and is then cooled to ambient temperature, and the controlled cooling comprises simultaneously:

(a) cooling the head of the rail to a temperature not lower than the Ms point of the steel forming the rail and at a rate lower than the critical quenching rate of the steel in such a way that the head acquires a fine perlitic structure;

(b) superficially cooling the web of the rail to a temperature equal to or lower than the Ms point of the steel and at a rate greater than that of the cooling of the head in such a way as to obtain a surface layer of martensite and/or bainite in the web of the core, the surface cooling of the web being controlled in such a way that, at the end of the cooling process, the internal portions of the web not transformed into martensite and/or bainite retain a sufficient degree of heat to carry out, by conduction, tempering of the transformed surface layer of the web during the final cooling; and (c) cooling the flange of the rail at a rate proportionate to that of the cooling of the web in order to avoid any difference of thermal deformation between the web and the flange of the rail so as to ensure that the rail is straight.

Preferably, the final cooling to the ambient temperature comprises in leaving the rail in the still air while the surface layer of the core web undergoes tempering under the heat which it draws, by conduction, from the inner portions of the web. Also by conduction, these portions draw heat from the head, which is cooled less quickly than the web. During this final cooling, the inner portions of the web are transformed into perlite.

Through this complementary cooling of the head, according to the process of the invention, it is possible to obtain the required hardness of 400 Brinell whilst avoiding any formation of martensite in the head.

Within the scope of the present invention, the cooling intensities will be expressed by the average heat flux density characterising these coolings, i.e. the quantity of heat (Joules) drawn from the rail per unit of time (second) and per units of area ($m^2$) of the surface subjected to cooling; it is expressed in $MJ/s.m^2$ or $MW/m^2$.

The present invention will be better understood and other details thereof will emerge from the description below of a preferred embodiment given by way of example with reference to the accompanying drawings.

DETAILED DESCRIPTION OF PREFERRED EMBODIMENT

Figure 1:
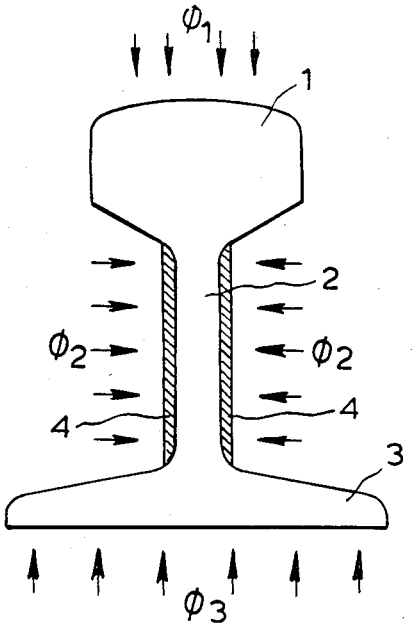
FIG. 1 illustrates, in diagrammatic form, the different cooling processes applied simultaneously to the rain in a controlled cooling zone, indicating the resulting structures in the web.

FIG. 1 represents, in transverse section, a rail having a head 1, a web 2, and a flange 3. In the course of controlled cooling the consituent parts of the rail are subjected to respective cooling intensities $\phi_1$, $\phi_2$, and $\phi_3$, represented by arrows. The average density of the heat flux from the head, $\phi_1$, causes a cooling which gives rise to the perlitic transformation in the head 1 without the formation of martensite. In the web 2, this average heat flux density $\phi_2$ is much higher than $\phi_1$ and gives rise to surface hardening of the web, quenched surface layers 4, consisting of martesite and/or bainite, forming in the two surfaces of the web 2. Finally the average heat flux density $\phi_3$ from the flange 3 is proportionate to $\phi_2$ so that any difference of thermal deformation between the web and the flange is avoided, and straighteness of the rail during and after treatment is thus ensured. The rapid cooling of the web 2 has the effect of drawing heat from the head 1 and of contributing to the cooling thereof. This effect is not sudden, however, and does not lead to the formation of martensite in the head. It is nevertheless permits one to reduce the average heat flux density $\phi_1$ and thus to slow down the external cooling of the head.

After this controlled differential cooling, the rail undergoes cooling in still air, during which the heat remaining in the non-quenched portion of the web causes the tempering of the surface layers 4.

The present invention also relates to apparatus for carryig out the controlled cooling process which has just been described.

Figure 2:
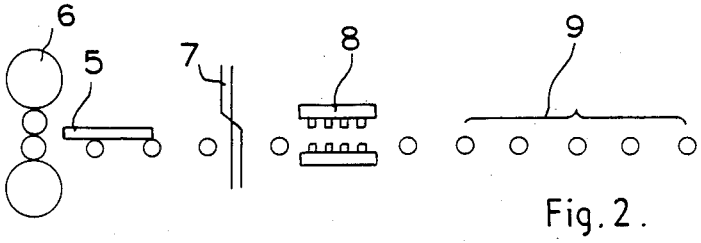
FIG. 2 shows, greatly simplified, a controlled rail-cooling plant at the exit of the hot rolling mill.

FIG. 2 shows, in a greatly simplified manner, such apparatus installed at the exit of a rolling mill. In the direction of movement of the rail 5 emerging from the rolling mill 6, the plant comprises successively a saw 7 for cropping or cutting the rail to length, a controlled cooling device 8, and a plant 9 for cooling in still air. In a manner which is known per se, the rail advances continuously on a roller conveyor through the saw 7 and the cooling device 8 to the cooling plant 9.

Figure 3:
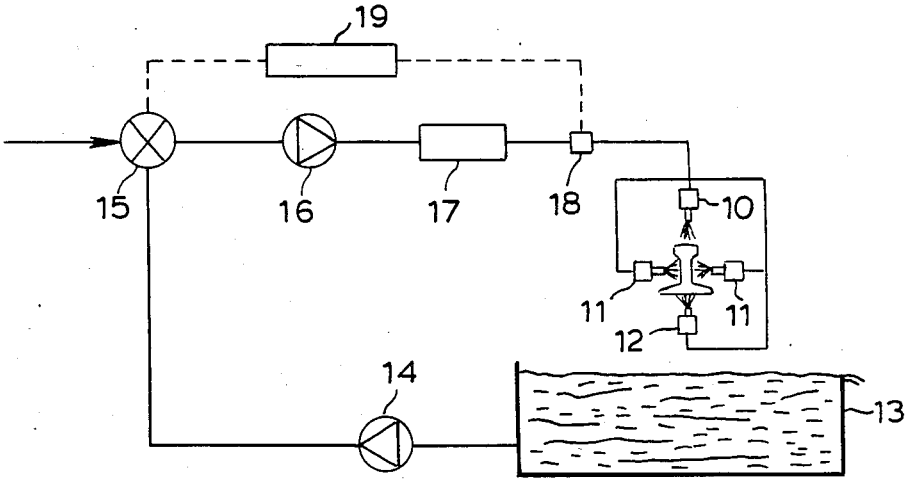
FIG. 3 is a diagrammatic representation of the circuit of the cooling water in apparatus according to the present invention.

FIG. 3 is a diagrammatic representation of the controlled rail-cooling device with the circuit of cooling water. The elements not essential to the understanding of the invention have deliberately been omitted.

Cooling boxes are disposed around the rail 4, seen here in transverse section, and are equipped, in a manner known per se, with jets 10,11,12 respectively carrying out the cooling of the head 1, the web 2, and the flange 3 (see FIG. 1) of the rail. The water for cooling the rail is then collected in a constant level tank 13, from which it is sent via a pump 14 towards a mixing valve 15. The latter is connected to a reserve water supply (not shown). The water is then sent to the jets 10,11,12 through a pump 16 and a filter 17. The apparatus also comprises a device 18 for measuring the temperature of the water sent to the jets and a regulator 19 which adjusts the position of the mixing valve 15 in relation to the temperature of the water in order to adjust the quantity of reserve water to be added to maintain the required temperature.

In FIG. 3 water channels are shown by solid lines and electrical conductors are shown by broken lines.

The cooling-water temperature is advantageously between 40° C. and 70° C.

This method, combined with an appropriate adjustment of the jet output makes it possible to adjust the average heat flux density in the different parts of the rail; in particular, it is possible to lower the value of $\phi_1$to the requisite level to avoid the formation of martensite in the flange.

The cooling water circulates in a closed circuit. When necessary, a certain amount of water is added at the ambiant temperature by the mixing valve 15 in order to keep the temperature of the water measured at 18 within the above-mentioned range of 40° C. to 70° C. Any excess water is drained via an overflow pipe provided in the tank 13.

Also, the water flow from the jets 11 is increased to the degree required to compensate the decrease in $\phi_2$ associated with the use of water at a relatively high temperature and thus to obtain the cooling intensity necessary to effect the intense surface cooling of the rail core.

With the process according to the invention, it is possible to manufacture in continuous manner rails having a head with a hardness of 400 Brinell without any impairment of the other mechanical or geometric properties mentioned in the introduction of the present specification.

I claim:

1. In a process for the continuous manufacture of a steel rail having a head, a web and a flange, in which said rail is subjected to a controlled cooling from a temperature at least equal to the $A_3$ transformation point of the steel immediately after it emerges from a hot rolling mill and in which said rail is finally cooled to the ambient temperature, said controlled cooling including simultaneously cooling the head of the rail to a temperature not lower than the Ms point of the steel at a rate lower than the critical quenching of the steel in such a way that the head acquires a fine perlitic structure and cooling the flange of the rail at a rate proportionate to that of the cooling of the web in order to avoid any difference of thermal deformation between the flange and the web so as to ensure that the rail is straight, the improvement that the said controlled cooling further comprises simultaneously:

supervicially cooling the web of the rail to a temperature equal to or lower than the Ms point of the steel at a rate greater than that of the cooling of the head, in such a way to obtain a surface layer of martensite and/or bainite in the web, and controlling said surface cooling of the web in such a way that, at the end of the controlled cooling, internal portions of the web not transformed into martensite and/or bainite retain a sufficient degree of heat to carry out, by conduction, tempering of the surface layer of the web during said final cooling.

2. The process of to claim 1, in which the controlled cooling of the different parts of the rail comprises spraying water on to the said parts of the rail.

3. The process of claim 2, in which the temperature of the cooling water is 40° to 70° C.

4. The process of claim 2, in which the cooling water circulates in a closed circuit.

5. The process of claim 2, further comprising the steps of measuring the temperature of the cooling water before spraying, and adjusting its temperature by selectively adding water at ambient temperature.

6. A method as claimed in claim 1, wherein said controlled cooling of the head, the web and the flange of the rail is interrupted simultaneously.

7. A method as claimed in claim 6, wherein said controlled cooling is interrupted when the surfrace of the web reaches said temperature below the Ms point of the steel.

8. A method as claimed in claim 7, wherein the head of the rail has a fine perlitic structure at the end of said controlled cooling.

9. A method as claimed in claim 1, wherein said internal portions of the web transform into perlite during said final cooling.

* * * * *